US008373668B2

(12) United States Patent
Lee et al.

(10) Patent No.: US 8,373,668 B2
(45) Date of Patent: Feb. 12, 2013

(54) ELECTROPHORETIC DISPLAY APPARATUS AND OPERATING METHOD THEREOF

(75) Inventors: Il-Pyung Lee, Suwon-si (KR); Cheol-Woo Park, Suwon-si (KR); Ho-Yong Jung, Hwaseong-si (KR); Joo-Young Kim, Suwon-si (KR)

(73) Assignee: Samsung Display Co., Ltd. (KR)

( * ) Notice: Subject to any disclaimer, the term of this patent is extended or adjusted under 35 U.S.C. 154(b) by 1064 days.

(21) Appl. No.: 12/337,603

(22) Filed: Dec. 17, 2008

(65) Prior Publication Data

US 2009/0231266 A1 Sep. 17, 2009

(30) Foreign Application Priority Data

Mar. 25, 2008 (KR) ..... 2008-27477

(51) Int. Cl.
*G09G 3/34* (2006.01)

(52) U.S. Cl. ..... 345/173; 345/204; 345/212; 345/107

(58) Field of Classification Search ..... None
See application file for complete search history.

(56) References Cited

U.S. PATENT DOCUMENTS

| | | | | |
|---|---|---|---|---|
| 5,448,262 | A * | 9/1995 | Lee et al. | 345/212 |
| 6,538,675 | B2 * | 3/2003 | Aratani et al. | 715/856 |
| 6,791,740 | B2 * | 9/2004 | Katase | 359/281 |
| 2003/0063076 | A1 * | 4/2003 | Machida et al. | 345/204 |
| 2004/0085610 | A1 * | 5/2004 | Katase | 359/245 |
| 2005/0099370 | A1 * | 5/2005 | Shin | 345/76 |
| 2007/0047003 | A1 * | 3/2007 | Suwabe et al. | 358/296 |
| 2007/0247417 | A1 * | 10/2007 | Miyazaki et al. | 345/107 |
| 2009/0040201 | A1 * | 2/2009 | Kim et al. | 345/204 |

FOREIGN PATENT DOCUMENTS

| | | |
|---|---|---|
| JP | 2004-101746 | 4/2004 |
| JP | 2005-345624 | 12/2005 |
| JP | 2007-058113 | 3/2007 |

* cited by examiner

*Primary Examiner* — Van Chow
(74) *Attorney, Agent, or Firm* — Innovation Counsel LLP

(57) ABSTRACT

Disclosed are embodiments of an electrophoretic display apparatus and an operating method thereof. According to one or more embodiments, an update voltage compensating for the degradation of an image is applied to a related pixel after a predetermined time interval elapses, when a plurality of images are consecutively displayed on one screen. Thus, the update voltage may be prevented from being applied to the pixel before the image degradation occurs, thereby preventing the pixel from being over-charged.

7 Claims, 6 Drawing Sheets

ELECTROPHORETIC DISPLAY APPARATUS AND OPERATING METHOD THEREOF

CROSS-REFERENCE TO RELATED APPLICATION

This application claims priority to and benefit from Korean Patent Application No. 2008-27477 filed on Mar. 25, 2008, the contents of which are herein incorporated by reference in their entirety.

BACKGROUND

1. Technical Field

Embodiments of the present invention relate to an electrophoretic display apparatus and an operating method thereof. More particularly, embodiments of the present invention relate to an electrophoretic display apparatus capable of displaying a plurality of images on one screen and a method of operating the electrophoretic display apparatus.

2. Description of the Related Art

Electrophoretic display apparatuses have been extensively used in various electronic devices such as a portable electronic dictionary, a portable mobile product and so on. Generally, the electrophoretic display apparatus includes a display panel and a driver. The display panel includes two substrates facing each other and an electrophoretic layer interposed between the two substrates. The two substrates are provided with first and second electrodes, respectively. The electrophoretic layer includes charged particles moving between the first and second electrodes due to a potential difference formed between the first and second electrodes. The driver applies voltage pulses in the form of direct current (DC) corresponding to an image to one of the first and second electrodes, so that the potential difference occurs between the first and second electrodes. If the potential difference occurs between the first and second electrodes, the particles are aligned in a predetermined position between the first and second electrodes. A predetermined image is displayed according to the alignment state of the particles. Such an electrophoretic display apparatus continuously displays an image corresponding to the voltage pulses even if the voltage pulses are not supplied to the display panel. Accordingly, the electrophoretic display apparatus continuously displays a predetermined image with low power consumption.

Meanwhile, the electrophoretic display apparatus employs a driving scheme different from a driving scheme of a conventional display apparatus (e.g., a liquid crystal display) because the electrophoretic display apparatus uses charged particles. For example, if the voltage pulses are not applied to the display panel for a long time, the image corresponding to the voltage pulses loses an intrinsic gray scale level. This is because the particles move from a predetermined position corresponding to the intrinsic gray scale level to another position due to several causes. Accordingly, the electrophoretic display apparatus requires an additional voltage periodically applied to the display panel in order to maintain the intrinsic gray scale level. In other words, the additional voltage is applied to the display panel at a time point when a user senses the degradation of an image.

In the electrophoretic display apparatus, if voltage pulses having the same polarity are continuously applied to a pixel during plural previous frames, a predetermined amount of charges are continuously accumulated in the pixel, and the accumulated charges exert a bad influence on a voltage pulse applied to a present frame. Accordingly, the electrophoretic display apparatus performs direct current balancing to apply a voltage pulse having a polarity opposite to a polarity of a voltage pulse during previous frames to the pixel, thereby removing charges accumulated in the pixel.

Conventionally, when a plurality of images are sequentially displayed on one screen, an additional voltage is simultaneously applied to the images at a predetermined time point regardless of the sequence of the displayed images. Accordingly, the additional voltage is applied in relation to remaining images except for an image that has been displayed in the first stage, even though the gray scale of the remaining images is not actually degraded. Thus, pixels displaying the remaining images are over-charged, so that DC balancing of the voltage pulses applied to the pixels is not adjusted.

SUMMARY

Therefore, embodiments of the present invention provide an electrophoretic display apparatus capable of preventing pixels from being over-charged in the process of updating a plurality of images when the images are displayed on one screen.

Embodiments of the present invention also provide an operating method of the electrophoretic display apparatus.

In an exemplary embodiment of the present invention, the electrophoretic display apparatus includes a signal controller, a data driver, and an electrophoretic display panel. The signal controller sequentially outputs a plurality of data signals in response to a plurality of image signals, and counts a preset time interval from a time point to output the data signal. Thereafter, the signal controller sequentially outputs a plurality of update signals used to compensate for the data signals after the preset time interval has lapsed based on the count result. The data driver sequentially outputs a plurality of data voltages in response to the plural data signals and sequentially outputs a plurality of update voltages in response to the update signals after the preset time interval has lapsed. The electrophoretic display panel includes a pixel that includes a pixel electrode, a common electrode facing the pixel electrode, and electrophoretic particles interposed between the pixel electrode and the common electrode. The electrophoretic display panel moves the electrophoretic particles to a target position based on the data voltage applied to the pixel electrode. The electrophoretic display panel displays an image by maintaining the electrophoretic particles in the target position in response to the update voltage applied to the pixel electrode after the preset time interval has lapsed.

In another exemplary embodiment of the present invention, an operating method of an electrophoretic display apparatus is performed as follows. A plurality of data signals corresponding to a plurality of images are sequentially output. In this case, a preset time interval is counted from a time point to output the data signal, and a plurality of update signals are sequentially output after the preset time interval has elapsed. Thereafter, a plurality of data voltages are output in response to the plural data signals, and a plurality of update signals are output in response to the plural update signals after the preset time interval has elapsed. Then, the images are displayed in response to the data voltages, and degradation of the images is compensated for in response to the update voltages when a time interval of maintaining each image exceeds the preset time interval.

According to the above, time points at which gray scale levels of images sequentially displayed on one display screen are degraded are individually measured. Thereafter, based on the measurement result, update voltages compensating for the degradation of the images are prevented from being applied to related pixels before the gray scale levels of the images are degraded.

BRIEF DESCRIPTION OF THE DRAWINGS

The above and other advantages of the embodiments of the present invention will become readily apparent by reference to the following detailed description when considered in conjunction with the accompanying drawings wherein.

DETAILED DESCRIPTION

An electrophoretic display apparatus according to one or more embodiments of the present invention may prevent an additional voltage (hereinafter, referred to as "an update voltage") from being applied to a related pixel before an image is degraded. Prior to explaining the electrophoretic display apparatus, definition of terms used in the present specification will be described.

Figure 1:
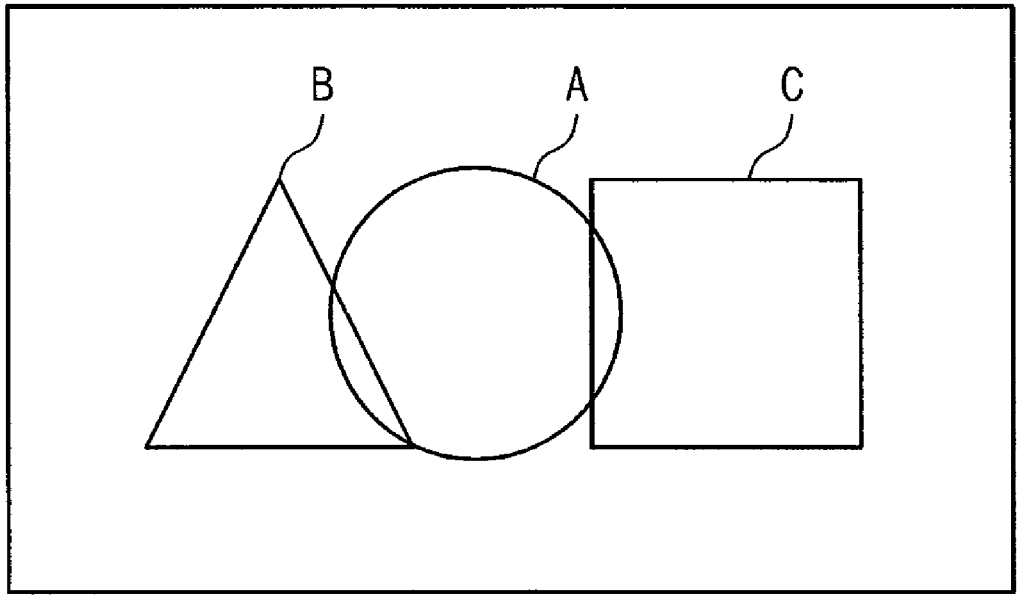
FIG. 1 is a view showing an example of images sequentially displayed on one display screen.

The term "image" described throughout the present specification is defined as an image consecutively displayed on one display screen by a user. Examples of such images are shown in FIG. 1. FIG. 1 shows three images including a circular image A, a triangular image B, and a rectangular image C sequentially displayed on one display screen, and the images are displayed in the sequence of A, B, and C. The images are input by a user through an input unit (e.g., a key pad) provided in the electrophoretic display apparatus according to one or more embodiments of the present invention. In addition, the images may be texts or various diagrams displayed on the display screen through the direct input of the user using the input unit such as an electro-pen or a touch screen panel. Thus, the electrophoretic display apparatus according to one or more embodiments of the present invention may be equipped with a touch screen function having a read operation mode and a write operation mode.

Conventionally, an update procedure to compensate for the degradation of images is simultaneously performed. In other words, update voltages are simultaneously applied to pixels corresponding to the images A, B, and C regardless of the display sequence of the images A, B, and C. As a result, the update voltage is applied to pixels representing the image C that is the latest displayed on one screen even though the gray scale of the image C is not degraded. Accordingly, the image C is over-charged, so that a data voltage applied to pixels representing the image C may not be subject to exact direct current (DC) balancing. Therefore, in the electrophoretic display apparatus according to one or more embodiments of the present invention, an update voltage is applied to a pixel after the gray scale levels of a plurality of images are degraded when the images are sequentially displayed on one display screen. The details thereof will be described below.

In addition, the expression "a time point of an image degradation" described throughout the present specification is defined as a time point at which a user starts to recognize the difference between a present gray scale level and a target gray scale level of a corresponding image. The time point of the image degradation may be variously determined depending on a panel characteristic, a gray scale level of the image, the number of frames for maintaining the gray scale level of the image, and a user recognition capability of the gray scale level.

The expression "a preset time interval" described throughout the present specification represents a time interval from a first time point when the gray scale level of a pixel reaches a target gray scale level in response to a data signal to a second time point when a user starts to recognize a difference between a present gray scale level and the target gray scale level.

Hereinafter, the electrophoretic display apparatus according to one or more embodiments of the present invention will be described with reference to the accompanying drawings.

Figure 2:
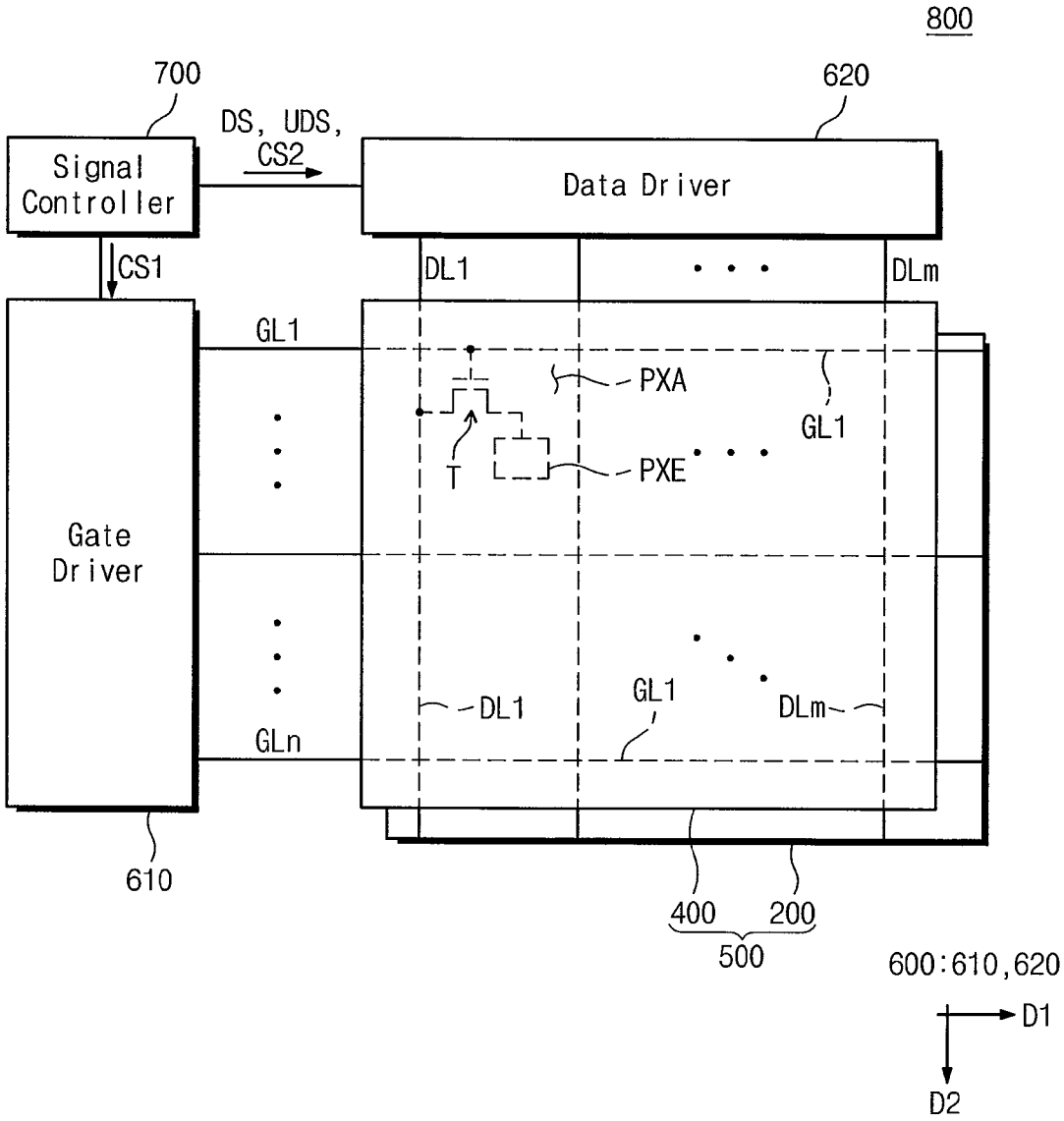
FIG. 2 is a block diagram showing an electrophoretic display apparatus according to an embodiment of the present invention.
Figure 3:
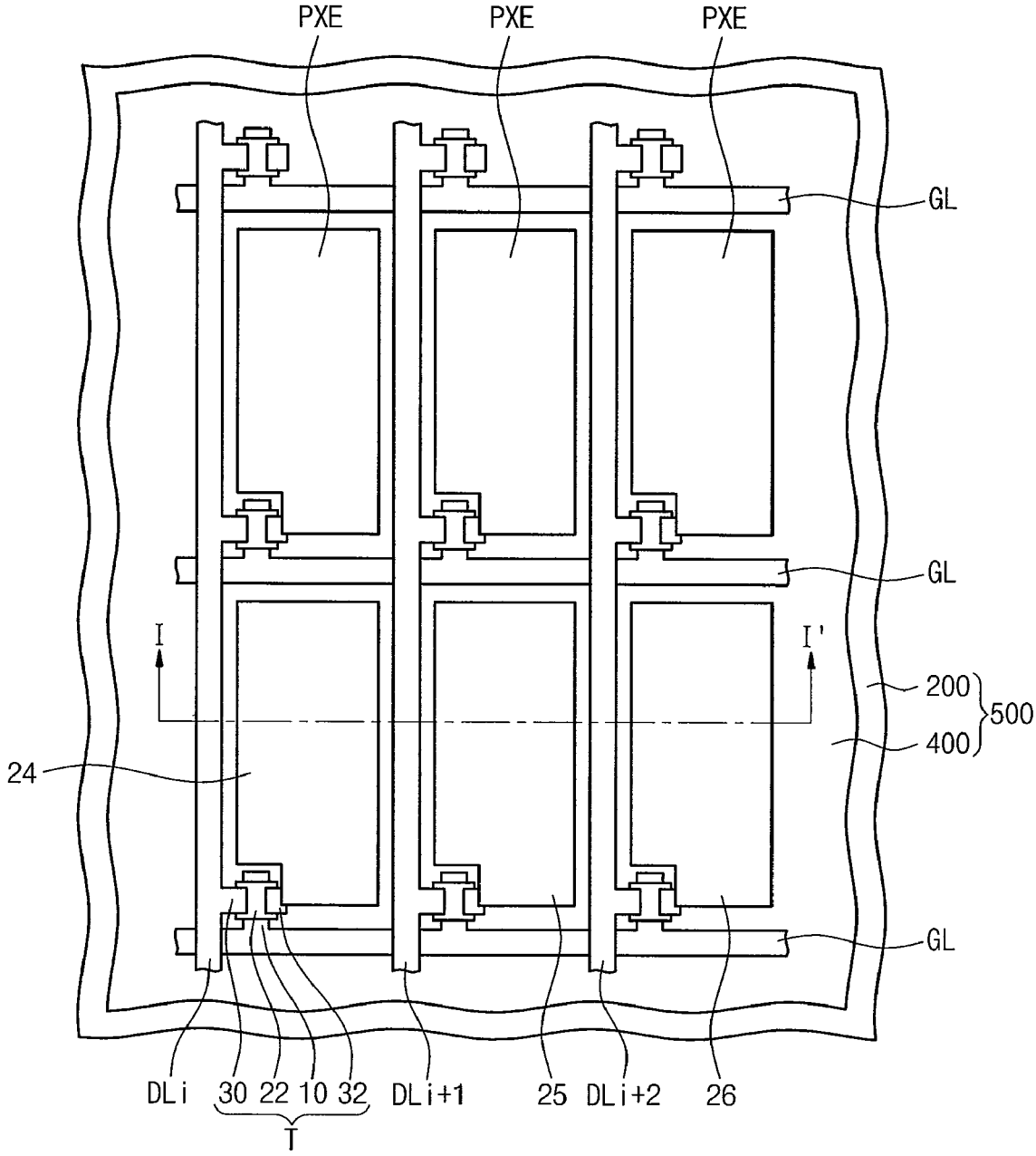
FIG. 3 is a plan view showing an electrophoretic display apparatus panel shown in FIG. 1 according to an embodiment.
Figure 4:
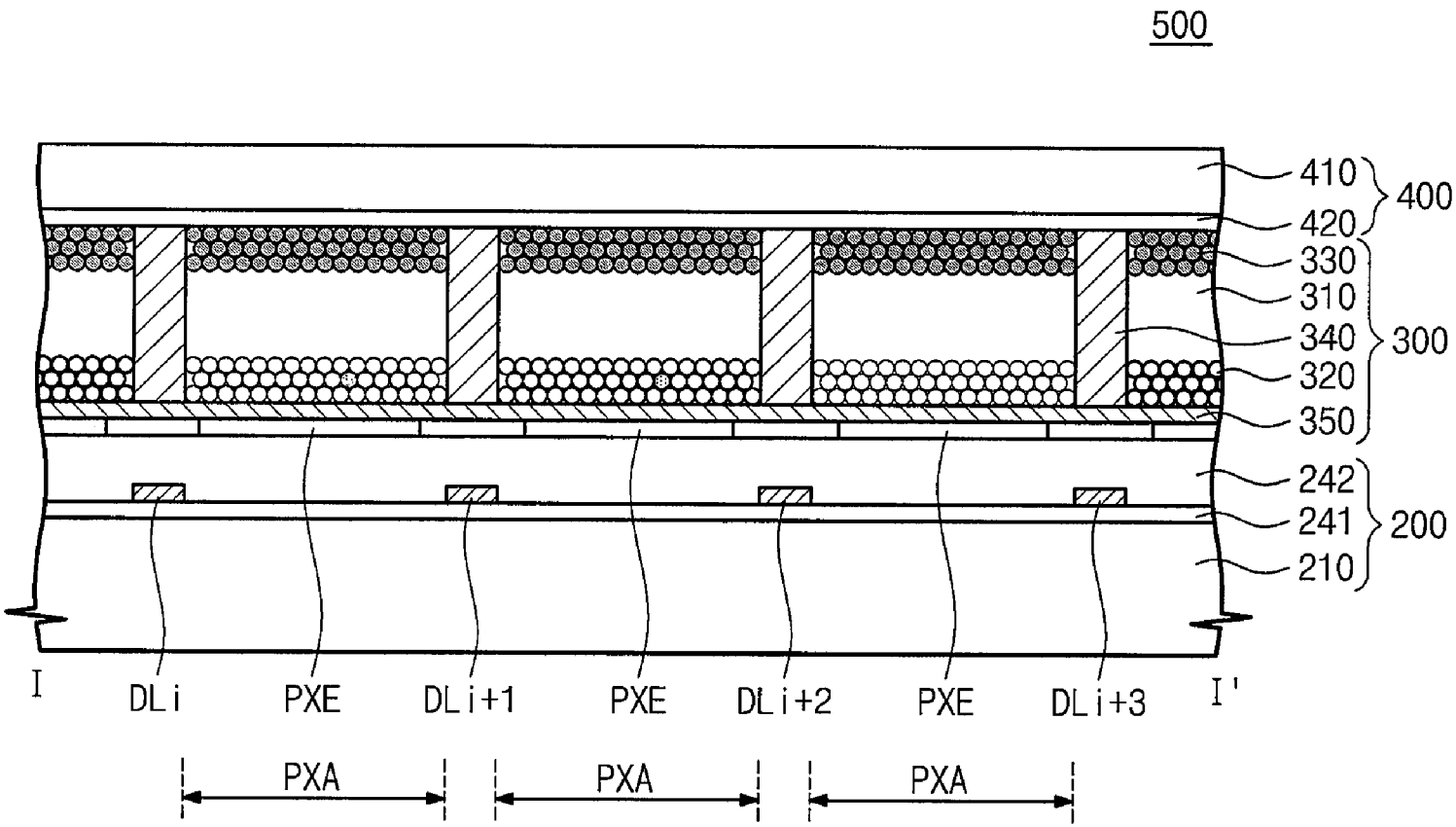
FIG. 4 is a cross-sectional view taken along a line I-I' of FIG. 3.

FIG. 2 is a view showing an electrophoretic display apparatus according to an embodiment of the present invention, and FIG. 3 is a plan view showing the electrophoretic display apparatus shown in FIG. 1 according to an embodiment. FIG. 4 is a sectional view taken along a line I-I' of FIG. 3.

Referring to FIGS. 2-4, an electrophoretic display apparatus 800 includes an electrophoretic display apparatus panel 500 (hereinafter, referred to as "a display panel") to display an image, a gate driver 610, a data driver 620, and a signal controller 700.

The display panel 500 includes a first display substrate 200, a second display substrate 400 facing the first display substrate 200, and an electrophoretic layer 300 interposed between the first display substrate 200 and the second display substrate 400.

The first display substrate 200 includes a first base substrate 210. The first substrate 210 is provided thereon with a plurality of gate lines GL1 to GLn and a plurality of data lines DL1 to DLm.

The gate lines GL1 to GLn extend in a first direction D1. The gate lines GL1 to GLn are aligned in a second direction D2 substantially perpendicular to the first direction D1 while being parallel to each other. In addition, one end of each of the gate lines GL1 to GLn is electrically connected to the gate driver 610 to sequentially receive gate signals.

The data lines DL1 to DLm cross the plural gate lines GL1 to GLn such that the data lines DL1 to DLm are insulated from the gate lines GL1 to GLn. In other words, the data lines DL1 to DLm extend in the second direction D2. The data lines DL1 to DLm are aligned in the first direction D1 while being parallel to each other. Accordingly, a plurality of pixel areas PXAs are arranged in the form of a matrix by the gate lines GL1 to GLn and the data lines DL1 to DLm. In addition, one end of each of the data lines DL1 to DLm is electrically connected to the data driver 620 to receive data voltages and update voltages. In this case, the update voltages are applied to the data lines DL1 to DLm after preset time intervals elapse from time points when the data voltages are applied to the data lines DL1 to DLm.

Each pixel area PXA includes a thin film transistor T and a pixel electrode PXE.

The thin film transistor T is electrically connected to a data line and a gate line corresponding thereto. In detail, a gate electrode 10 and a source electrode 30 of the thin film transistor T are connected to the gate line GL and the data line DLi, respectively. The thin film transistor T receives the data voltage, the update voltage, and a gate voltage.

The pixel electrode PXE is connected to a drain electrode 32 of the thin film transistor T. Accordingly, when the thin film transistor T is turned on in response to the gate voltage, the pixel electrode PXE receives the data voltage and the gate voltage. The data voltage includes a positive voltage, a negative voltage, or a voltage of 0V. Similarly, the update voltage includes a positive voltage, a negative voltage, or a ground voltage. The data voltage and the update voltage have the form of a pulse, and may have the same pulse width. Alternatively, the data voltage and the update voltage may have different pulse widths. When the data voltage has a pulse width different from the pulse width of the update voltage, the pulse width of the update voltage may be designed to be narrower than the pulse width of the data voltage.

The second display substrate 400 is provided above the first display substrate 200.

The second display substrate 400 includes a second base substrate 410 facing the first base substrate 210. The second base substrate 410 is provided with a common electrode 420 (shown in FIG. 4) facing the pixel electrode PXE. The common electrode 420 (shown in FIG. 4) receives a common voltage. For example, the common voltage may be a ground voltage.

As shown in FIG. 4, the electrophoretic layer 300 is interposed between the first display substrate 200 and the second display substrate 400. The electrophoretic layer 300 includes a fluid layer 310 including an insulating liquid, a plurality of white particles 320, a plurality of black particles 330 dispersed in the fluid layer 310, and a barrier wall 340.

The white particles 320 have a white color. The white particles 320 may be charged with a positive polarity or a negative polarity and may be provided in each pixel area PXA. The black particles 330 have a black color. The black particles 330 may be charged with a polarity opposite to the polarity of the white particles 320 and may also be provided in each pixel area PXA.

The white particles 320 and the black particles 330 may move to one of the first and second display substrates 200 and 400 according to the potential difference between the common electrode 220 and the pixel electrode PXES. For example, when the white particles 320 are charged with a positive polarity, and the black particles 330 are charged with a negative polarity, a common voltage of 0 volts is applied to the common electrode 420. If a data voltage higher than the common voltage is applied to the pixel electrode PXE, the white particles 320 move to the common electrode 420 due to the potential difference (or an electromagnetic force) between the pixel electrode PXE and the common electrode 420, and the black particles 330 move toward the pixel electrode PXE. In this case, when a predetermined gray scale is displayed through the second display substrate 400, a user using the electrophoretic layer 300 recognizes a white gray scale through the second display substrate 400. Meanwhile, if the common voltage is applied to the common electrode 420, and a data voltage having a voltage level lower than a voltage level of the common voltage is applied to the pixel electrode PXE, the white particles 320 move to the pixel electrode PXE, and the black particles 330 move to the common electrode 420. Accordingly, the user may recognize a black gray scale through the second display substrate 400. If a data voltage having a level equal to the level of the common voltage is applied to the pixel electrode PXE, the potential difference does not occur between the pixel electrode PXE and the common electrode 420. Accordingly, the white and black particles 320 and 330 maintain a predetermined position placed before the data voltage having a voltage level equal to that of the common voltage is applied to the pixel electrode PXE. In other words, a predetermined gray scale level is displayed, which is recognized through the second display substrate 400 before the data voltage having the level equal to the level of the common voltage is applied to the pixel electrode PXE.

A gray scale between the white gray scale and the black gray scale is determined according to the colors and the number of the white and black particles 320 and 330 positioned at the second display substrate 200. The colors and the number of the white and black particles 320 and 330 positioned at the second display substrate 200 are determined according to the voltage level of the data voltage applied to the pixel electrode PXE. Accordingly, a predetermined gray scale recognized from a pixel area is determined according to the voltage level of the data voltage.

The barrier wall 340 separates the first display substrate 200 from the second display substrate 400 to form a receiving space where the fluid layer 310 and the white and black particles 320 and 330 are received. The barrier wall 340 surrounds each pixel area PXA and blocks the fluid layer 310 and the white and black particles 320 and 330 received in the receiving space from moving into an adjacent pixel area PXA.

In the present exemplary embodiment, one pixel includes the common electrode 420 provided above the receiving space, the pixel electrode PXE provided under the receiving space, and the black and white particles 320 and 330 provided in the receiving space between the common electrode 420 and the pixel electrode PXE.

According to the embodiment, a structure of the electrophoretic layer 300 is described as an example in which the fluid layer 310 and the white and black particles 320 and 330 are divided by the barrier wall 340 according to the pixel areas PXAs. However, the electrophoretic layer 300 may have a structure in which the fluid layer 310 and the white and black particles 320 and 330 are encapsulated. In this case, the barrier wall 340 would not be provided for the electrophoretic layer 300.

In FIG. 4, reference number 350 represents an adhesive member used to bond the electrophoretic layer 300 onto the first display substrate 200, and reference number 241 represents a first insulating layer 241 formed on the first base substrate 210 to cover the gate lines GL1 to GLn (not shown in FIG. 4). Reference number 242 represents a second insulating layer formed on the first insulating layer 241 to cover the thin film transistor T (shown in FIG. 3). In this case, the pixel electrode PXE is formed on the second insulating layer 242.

Referring back to FIG. 2, the gate driver 610 is electrically connected to one end of each of the gate lines GL1 to GLn, and sequentially outputs a gate voltage to the gate lines GL1 to GLn in response to a first control signal CS1.

The data driver 620 applies a plurality of data voltages to the display panel 500 in response to a plurality of data signals output from the signal controller 700. The signal controller 700 applies a plurality of update voltages corresponding to the plurality of data voltages to the display panel 500. In this case, the data driver 620 is controlled by the signal controller 700 such that the update voltages are output after a preset time interval elapses from a time point to output each data voltage.

In detail, the data driver 620 is electrically connected to one end of each of the data lines DL1 to DLm, and outputs a data voltage to a corresponding data line among the plural data lines DL1 to DLm in response to a second control signal CS2 and a data signal DS provided from the signal controller 700.

Thereafter, the data driver 620 outputs update voltages to the plurality of data lines DL1 to DLm in response to an update signal UDS provided from the signal controller 700 after the preset time interval has elapsed.

The signal controller 700 receives a plurality of image signals ISs including image information, a plurality of control signals CSs to control input timing of each image signal IS (see FIG. 5), and a reference clock RCLK (see FIG. 5) from an external device (not shown). If the electrophoretic display apparatus 800 according to the present exemplary embodiment is operable in a writing operation mode, the external device may include an electro-pen and a touch screen panel. Accordingly, in such an electrophoretic display apparatus, an electrophoretic display apparatus panel may be integrally manufactured with a touch screen panel through one process.

The signal controller 700 converts the image signals ISs into data signals DSs that are processable in the data driver 620 and sequentially outputs the data signals DSs in response to the control signal CS. The signal controller 700 counts a preset time interval from a time point to output the data signals DSs. If the preset time interval elapses, the signal controller 700 outputs the update signals UDSs corresponding to the data signals DSs based on the count result value.

Figure 5:
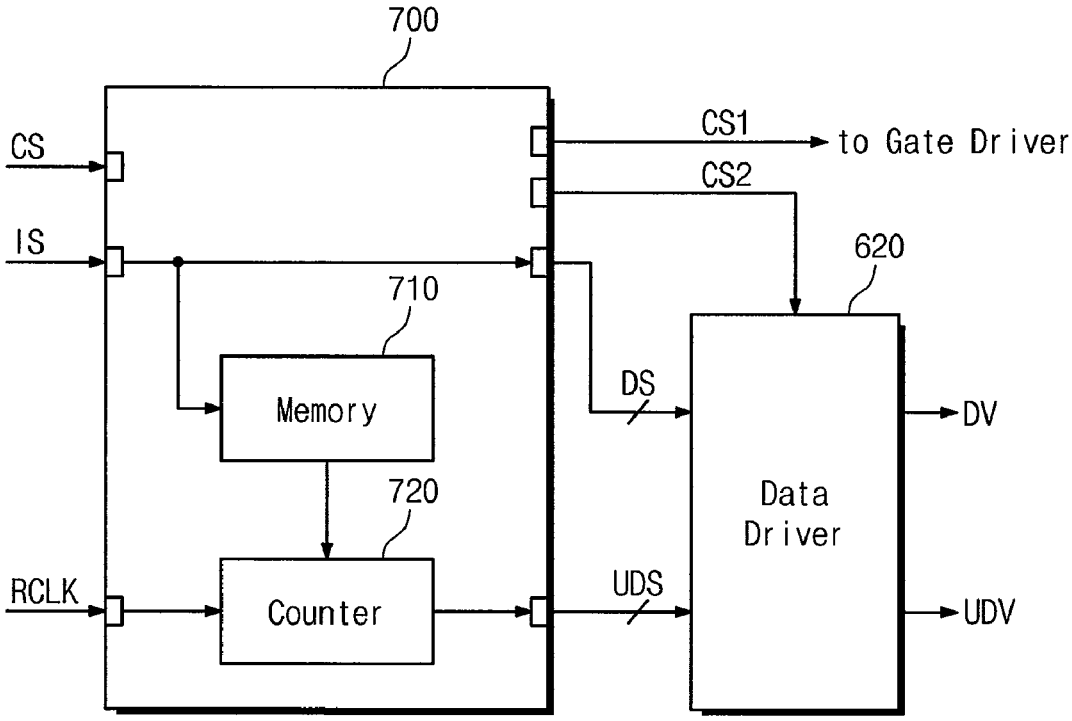
FIG. 5 is a view showing the structure of a signal controller shown in FIG. 1 according to an embodiment.

FIG. 5 is a view showing the signal controller 700 shown in FIG. 2 according to an embodiment. In FIG. 5, the signal controller 700 is shown together with the data driver 620 of FIG. 2.

Referring to FIG. 5, the signal controller 700 includes a memory 710 and a counter 720. The signal controller 700 sequentially stores time points to output the data signals DSs in the memory 710 as time information.

The counter 720 receives the time points to output the data signals DSs stored in the memory 710 as time information as well as the reference clock RCLK, and counts a preset time interval from the output time points of the data signals DSs. In detail, the counter 720 compares the number of clock pulses of the reference clock RCLK counted from the output time point of present data signal DS with the number of clock pulses of the reference clock RCLK corresponding to the preset time interval. If the number of the counted clock pulses reaches the number of clock pulses of the reference clock RCLK corresponding to the preset time interval, the counter 720 completes a counting operation for the preset time interval of the data signal DS, and generates a counting signal notifying that a time point of the degradation of an image corresponding to the data signal DS occurs. Thereafter, the signal controller 700 outputs present update signals UDSs corresponding to the data signals DSs based on the counting signal to the data driver 620.

Thereafter, the counter 720 counts a preset time interval from a time point to output a next data signal DS, and outputs to the data driver 620 a next update signal UDS corresponding to the next data signal DS according to the counting result.

As described above, the signal controller 700 individually counts time points of image degradation (a preset time interval), and determines time points to output update signals UDSs such that update signals UDSs corresponding to the images are output after the time points of the image degradation have elapsed.

As a result, in the electrophoretic display apparatus according to the present exemplary embodiment, an update procedure to compensate for the degradation of a corresponding image is not performed before the gray scale of the image is degraded when a plurality of images are continuously displayed on one screen.

Since the data driver 620 receives the data signal DS and the update signal UDS from the signal controller 700 with the above time interval, the data driver 620 applies the update voltage UDV to a related pixel after a preset time interval from a time point in which the data voltage DV is applied to the data lines DL1 to DLm.

Accordingly, the update voltage UDV is prevented from being applied to a related pixel before a preset time interval has elapsed, that is, before a corresponding image is degraded. Therefore, the pixel is not over-charged, so that DC balancing of a data voltage applied to the pixel may be exactly adjusted.

Figure 6:
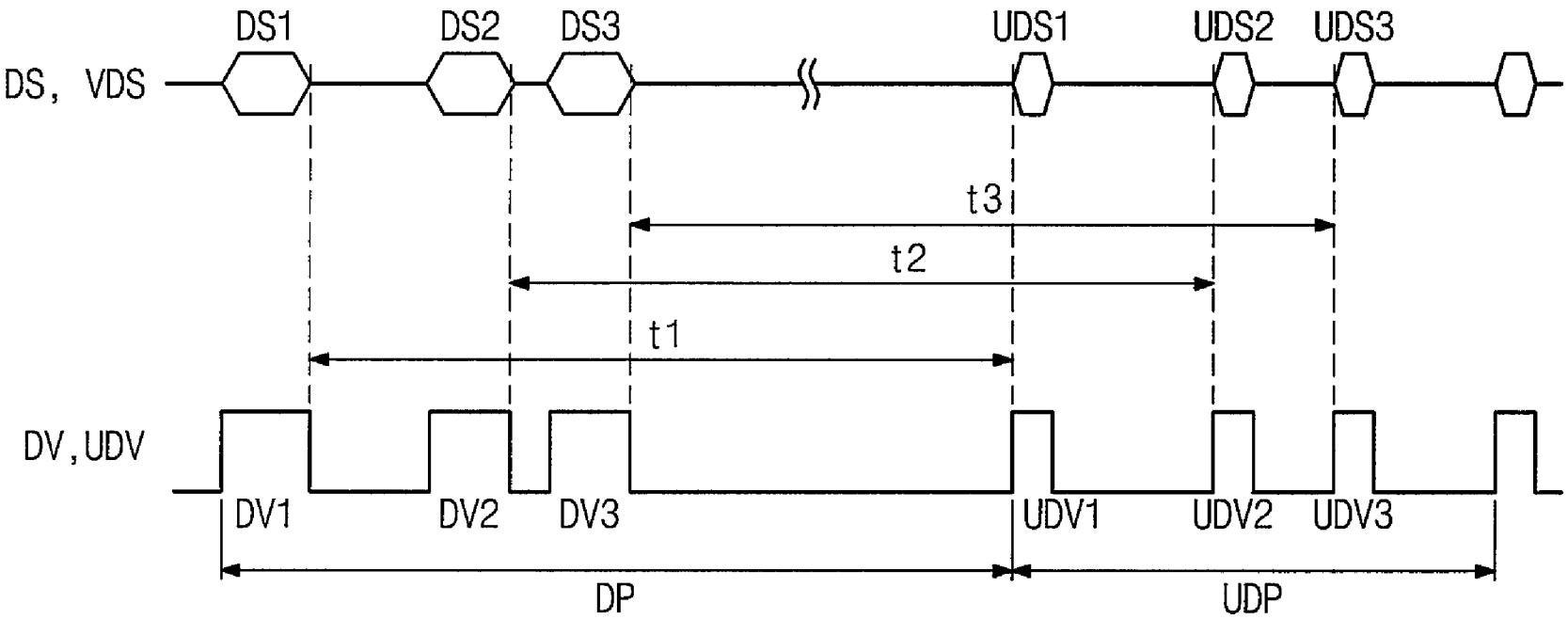
FIG. 6 is a timing chart showing output waveforms of a data voltage and an update voltage output from a data driver shown in FIG. 4 according to an embodiment.

FIG. 6 is a timing chart showing output waveforms of the data voltage DV and the update voltage UDV output from the data driver 620 of FIG. 5 according to an embodiment.

A display duration DP and an update duration UDP are shown in FIG. 6. Although it is not shown in FIG. 6, DC balancing of the data voltage DV is performed after the update duration UDP is performed.

For the display duration DP, first to third data signals DS1, DS2, and DS3 and first to third data voltages DV1, DV2, and DV3 are shown, in which the first to third data signals DS1, DS2, and DS3 are sequentially output from the signal controller 700, and the first to third data voltages DV1, DV2, and DV3 are sequentially output from the data driver 620 in response to the first to third data signals DS1, DS2, and DS3, respectively. The three data signals DS1, DS2, and DS3 may correspond to three images sequentially displayed on one display screen.

For the update duration UDP, first to third update signals UDS1, UDS2, and UDS3 and first to third update voltages UDV1, UDV2, and UDV3 are shown, in which the first to third update signals UDS1, UDS2, and UDS3 are sequentially output from the signal controller 700, and the first to third update voltages UDV1, UDV2, and UDV3 are output from the data driver 620 in response to update signals UDS1, UDS2, and UDS3, respectively.

Referring to FIG. 6, the signal controller 700 outputs the first update signal UDS1 if a first preset time interval t1 elapses from a time point (a transition time point from a high-level signal to a low-level signal) to output the first data signal DS1, and outputs the second update signal UDS2 if a second preset time interval t2 elapses from a time point to output the second data signal DS2. Similarly, the third update signal UDS3 is output from the signal controller 700. Accordingly, the first to third update voltages UDV1, UDV2, and UDV3 are output to related pixels after the first to third preset time intervals t1, t2, and t3 elapse. In this case, the first to third preset time intervals t1, t2, and t3 are the same time interval.

The preset time interval may be variously set according to image information including the gray scale level of a displayed image and the number of frames for maintaining the gray scale level of the image and a panel characteristic. For example, the level of a data voltage corresponding to a high gray scale is different from the level of a data voltage corresponding to an intermediate gray scale. A time point of the degradation of an image having a high gray scale may be different from a time point of the degradation of an image having an intermediate gray scale due to the above difference in the voltage level. Accordingly, an output time point of an update voltage used to compensate for the degradation of the high-gray-scale image may be different from an output time point of an update voltage used to compensate for the degradation of the intermediate-gray-scale image. Therefore, according to the present exemplary embodiment, although the first to third preset time intervals t1, t2, and t3 may have the same time interval as described, the preset time intervals t1, t2, and t3 may be different from each other according to information about images sequentially displayed on the display screen.

In the electrophoretic display apparatus and the operating method thereof, time points at which gray scale levels of images sequentially displayed on one display screen are degraded are individually measured. Thereafter, based on the measurement result, update voltages compensating for the degradation of the images are prevented from being applied to related pixels before the gray scale levels of the images are degraded. Therefore, the DC balancing of voltage pulses corresponding to the images may be precisely adjusted after the images have been updated.

Although the exemplary embodiments of the present invention have been described, it is understood that the present invention should not be limited to these exemplary embodiments but various changes and modifications can be made by one ordinary skilled in the art within the spirit and scope of the embodiments of the present invention as hereinafter claimed.

What is claimed is:

1. An electrophoretic display apparatus comprising:

a signal controller that is configured to sequentially output a plurality of data signals in response to a plurality of image signals, select one of a plurality of preset time intervals, count the selected preset time interval from a time point to output the data signals, and sequentially output plurality of update signals used to compensate for the data signals after the selected preset time interval has lapsed based on a count result;

a data driver that sequentially outputs a plurality of data voltages in response to the plurality of data signals and sequentially outputs a plurality of update voltages in response to the update signals after the preset time interval has lapsed; and an electrophoretic display apparatus panel that comprises a pixel comprising a pixel electrode, a common electrode facing the pixel electrode, and electrophoretic particles interposed between the pixel electrode and the common electrode, wherein the electrophoretic display apparatus is configured to receive the output data voltages and to apply one or more of the data voltages to the pixel electrode so as to direct the electrophoretic particles to a target position based on the data voltage applied to the pixel electrode, and is configured to maintain display of an image by maintaining the electrophoretic particles in the target position in response to the update voltage applied to the pixel electrode after the preset time interval has lapsed.

2. The electrophoretic display apparatus of claim 1, wherein the signal controller comprises:

a memory configured to store output time points of the data signals as time information; and a counter configured to receive the time information stored in the memory and counts the selected preset time interval from the output time point of each data signal.

3. The electrophoretic display apparatus of claim 1, wherein the selected preset time interval comprises a time interval between first and second time points, in which the pixel displays a target gray scale level corresponding to the target position at the first time point and the pixel displays another gray scale level at the second time point.

4. The electrophoretic display apparatus of claim 1, wherein preset time intervals corresponding to the data signals are equal to each other.

5. The electrophoretic display apparatus of claim 1, wherein preset time intervals corresponding to the data signals are different from each other.

6. The electrophoretic display apparatus of claim 5, wherein the preset time intervals corresponding to the data signals are determined according to image information of the data signals.

7. The electrophoretic display apparatus of claim 6, wherein the image information comprises a gray scale level of an image corresponding to the data signals and a number of frames for maintaining the gray scale level.

* * * * *